United States Patent [19]

Ruetz

[11] 4,008,820

[45] Feb. 22, 1977

[54] PLASTICS MATERIAL CLOSURE MEMBER FOR A CONTAINER

[76] Inventor: Joseph Ruetz, Jurastrasse 41, 2502 Biel, Switzerland

[22] Filed: Dec. 10, 1975

[21] Appl. No.: 639,415

[30] Foreign Application Priority Data

Dec. 16, 1974 Switzerland ..... 16725/74

[52] U.S. Cl. ..... 215/256; 215/295; 215/320; 215/355

[51] Int. Cl.[2] ..... B65D 41/18

[58] Field of Search ..... 215/295, 296, 305, 319, 215/320, 321, 354, 355, 256; 220/281, 282, 306

[56] References Cited

UNITED STATES PATENTS

| | | | |
|---|---|---|---|
| 2,768,762 | 10/1956 | Guinet | 215/320 |
| 3,233,771 | 2/1966 | Chiang | 215/320 |
| 3,834,571 | 9/1974 | Bartell | 215/354 X |
| 3,858,742 | 1/1975 | Grussen | 215/320 X |

FOREIGN PATENTS OR APPLICATIONS

| | | | |
|---|---|---|---|
| 1,088,929 | 9/1954 | France | 215/354 |
| 1,164,687 | 5/1958 | France | 215/355 |
| 1,324,564 | 3/1963 | France | 215/296 |

*Primary Examiner*—Donald F. Norton
*Attorney, Agent, or Firm*—Imirie, Smiley & Linn

[57] ABSTRACT

A plastic material closure member for a container, said closure member having a gripping portion and a substantially cylindrical sealing portion adjacent thereto, in which the sealing portion comprises a sealing wall and a centering member adjacent thereto, and in which the walls of the gripping portion, the centering member and the sealing wall are laterally deformable.

10 Claims, 7 Drawing Figures

PLASTICS MATERIAL CLOSURE MEMBER FOR A CONTAINER

BACKGROUND OF THE INVENTION

The present invention relates to a plastic material closure member for a container, having a gripping portion, and a substantially cylindrical sealing portion adjacent thereto, and which is preferably intended as a closure means for bottles or tubes.

The main problem in all threadless plastic material closures, in contrast to screw closures, resides in the provision of ready opening and closing of the sealing portion of the closure member in a container neck which is difficult to open and tightly fitting, apart from the extremely slight annular adhesion about the bead portion in the container neck. The positional movement of this sealing portion in threadless plastic material closures is only possible in the distribution of the force in various directions with transmission of the forces on to the inner sealing portion. In all known hermetically sealing threadless closures, the sealing portion is made of relatively rigid and hence hardened plastic material. Therefore this sealing portion as such is substantially inflexible and in the uppermost region of attachment to the container neck is practically unmovably connected to the horizontally mounted, non-displaceable walls directly over the end face of the container. This lateral upper most blocking is therefore, especially at the beginning, the greatest problem during opening of a threadless closure, particularly since this uppermost laterally non-displaceable region in its inflexibility for opening or loosening of the tightly fitting sealing portion requires considerable effort to effect vertical movement of the sealing portion to overcome this region. More especially, even with closures having a rigid sealing portion and only a minimal lateral displaceability, such closures may only be inserted into the neck of a container by the use of maximum effort with straddle and rocking movements, since no direction-controlling pre-centering in the lowermost region of the sealing portion is provided.

This partially uppermost lateral blocking of the sealing portion is moreover also disadvantageous in consideration of the external and internal container neck tolerances. Moreover, crown-top closures for beverage bottles are known which after the filling of the bottles are placed thereon and by means of a tool are so deformed that the edge portions engage positively around a bead formed on the bottle orifice, whereby the bottles are tightly sealed. For opening such bottles numerous tools have been developed, whereby during the opening procedure the edge portions of the closure are so deformed that the latter cannot be used a second time with the same closure effect on the container. This is especially of considerable disadvantage when it is not intended to empty the whole contents of the bottle.

Furthermore, closures for bottles have been proposed which are made of rubber or soft plastic material and which due to their considerable resilience can be inverted over the orifice of the bottle. Since the tolerance limits in bottle necks are relatively large, it frequently happens that the known closures made of soft plastic material perfectly seal bottles having a lip or bulge within the upper tolerance limit, but can only be removed with considerable effort, or that bottles having a lip or bulge within the lower tolerance limit may in fact very readily be removed but provide no hermetic sealing effect. Moreover, attaching such closures to a container neck is not quite simple inasmuch as there are no provisions made to center the closure itself. Closures are also known which have relatively thin sealing part walls in which insertion and removal is relatively easy, but which, however, no longer ensure a hermetic seal.

SUMMARY OF THE INVENTION

It is an object of the present invention to provide a closure which during attachment centers itself relative to the opening to be closed and which also provides a hermetic sealing effect when the diameter of the opening to be closed of the container varies within relatively wide limits and which especially permits easy removal and closing and furthermore is applicable on a large variety of containers.

According to the present invention there is provided a plastic material closure member for a container, said closure member having a gripping portion and a substantially cylindrical sealing portion adjacent thereto, in which the sealing portion comprises a sealing wall and a centering member adjacent thereto, and in which the walls of the gripping portion, the centering member and the sealing wall are laterally deformable.

Preferably, the gripping portion is provided with means, located concentrically to the sealing portion, for receiving the edge region of the container opening. The means for receiving the edge region of the container opening preferably comprises a flexible member which with the sealing wall forms a cavity over the end face of the container.

The invention will be further illustrated, by way of example, with reference to the accompanying drawings.

DESCRIPTION OF THE PREFERRED EMBODIMENTS

Figure 1:
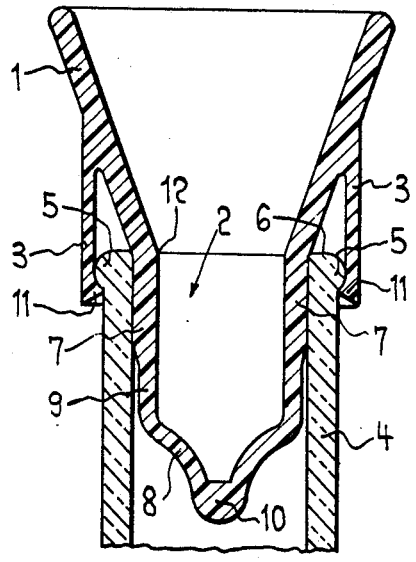
FIG. 1 is a sectional view of a closure member in accordance with the present invention fitted onto a bottle neck.

In FIG. 1 there is shown a closure member comprising a gripping portion 1, a sealing portion 2 and a flexible member 3 for receiving the edge portion of the container opening. The closure member in the present case closes a bottle, the bottle having a neck 4, a bead portion 5 and an end face 6. The sealing portion 2 consists of a substantially cylindrical sealing wall 7 and a centering member 8 adjacent thereto. The centering member 8 has a cylindrical centering and sealing wall 9, which is generally thinner than the sealing wall 7, and wall 9 tapers and merges into a solid, substantially non-deformable and thickened base 10. The open end of the flexible member 3 is formed as a rib 11 which embraces the bead portion 5 of the neck of the bottle 4.

Decisive for the good functioning of the closure member in accordance with the invention on the one hand is the manufacture of the parts thereof from laterally deformable plastic material and on the other hand the development of a fixed base 10; moreover, the divison of the sealing portion into a sealing wall and centering member. As readily shown in FIG. 1, the lateral deformability of the gripping portion, especially about the transition point 12 enables a ready detaching of both the rib 11 from the bead portion 5 and of the sealing wall 7 from the neck 4 of the bottle, whereby, it should be stressed, that the sealing wall 7 is also laterally deformed. On the other hand, this closure member also has an excellent sealing property. Thus, it should be stressed particularly that due to the relatively rigid and solid development of the base 10, pressure is exerted on the sealing wall 7 via the centering wall 9. This provides as additional advantage that relatively large tolerances in the neck of the bottle can be compensated without losing the excellent sealing properties.

Figure 2:
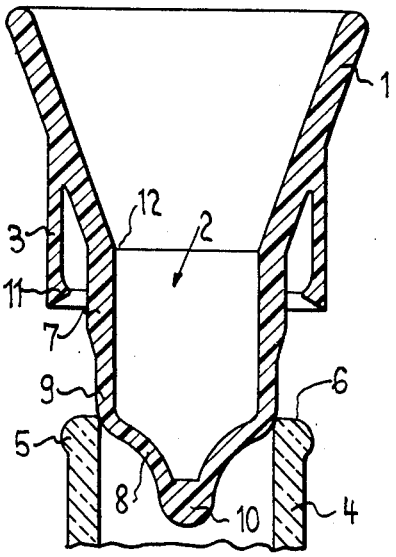
FIG. 2 is a sectional view of the closure member of FIG. 1 during insertion thereof into the bottle neck.

In FIG. 2 the centering member 8 enables the closure member of the invention to be utilized with an automatic filling and sealing apparatus. At first the closure member, by means of the base 10 is roughly pre-centered, subsequently the centering wall 9 is inserted, whereby FIG. 2 shows that the external diameter of this centering and closure wall 9 is already slightly larger than the internal diameter of the neck of the bottle 4. This means that the closure member already in this stage acts in a sealing manner and is fully centered. It is clear that the closure member needs to be pushed in only with this centering wall if no complete hermetic seal is required. This above all applies to containers in daily use domestically, such as for example, in the case of lemonade bottles. It should, however, be stressed that this centering member already seals better than any other screw or crown cap, which has already been opened once. From the above description of the first alternative embodiment of the closure member in accordance with the invention, the considerable advantages obtained compared with conventional closure is clearly shown. By using an easily deformable plastics material for the parts of the closure member, especially for the sealing wall, there is obtained a ready closing and opening of this closure member and especially a perfect sealing. Moreover, it has to be stressed that this sealing occurs in the interior of the container and not on its end face.

Figure 3:
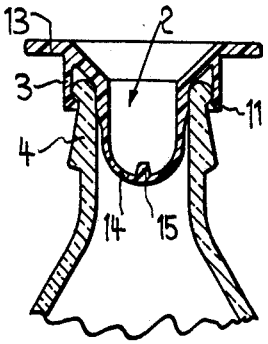
FIG. 3 is a sectional view of a second embodiment of a closure member in accordance with the invention.

In FIG. 3 there is shown a further alternative embodiment, whereby a closure member of smaller dimensions is utilized and the uppermost part 13 of the gripping portion, in order to save space and to permit the sealed containers to be stacked one upon another, is horizontally positioned; however the functions obtained by such closure member are in substantial agreement with that of the closure member shown in FIG. 1. Moreover, the centering member 14 is of semi-circular form, whereby the base 15 projects in the form of an inwardly directed plug.

Figure 4:
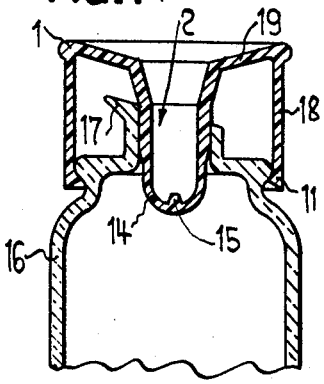
FIG. 4 is a sectional view of a third embodiment of a closure member in accordance with the invention for insertion into the neck of a bottle via a pouring lip.

In FIG. 4 a further alternative embodiment of the closure member is shown. This alternative embodiment is intended for a container, especially a bottle 16 provided with a pouring lip 17. The flexible member 18 projects down from the end of the substantially horizontally located end member 19 of the gripping portion 1 and also has a rib 11. Since, as already mentioned, the container is sealed by means of a sealing portion 2, a hermetic seal is also ensured herein. The sealing portion with the centering member is adapted in a similar manner as to the closure member shown in FIG. 3.

Figure 5:
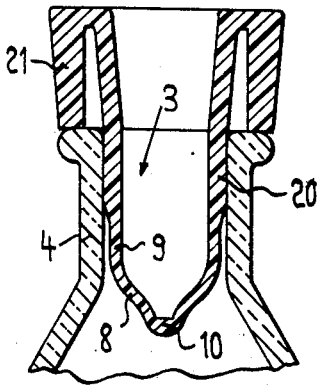
FIG. 5 is a sectional view of a fourth embodiment of a closure member in accordance with the invention formed as a plug.

In FIG. 5 the closure is formed as a plug, whereby the sealing wall 20 is longer than in the preceding embodiments and the flexible member is omitted. The gripping portion has an inverted U-shaped profile, whereby the outer surface 21 thereof in the inserted state of the plug abuts against the end face of the container. The centering member of the closure is formed substantially similar to that of FIG. 1 and fulfils the same functions.

Figure 6:
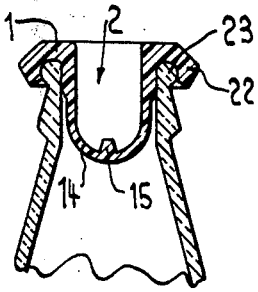
FIG. 6 is a sectional view of a fifth embodiment of a closure member in accordance with the invention.

FIG. 6 shows a further alternative embodiment, whereby the gripping portion 1 is substantially formed as flexible member 22, which embraces the bead portion 23 of a bottle, whilst the centering member is formed similarly to that of FIGS. 3 or 4. Herein, moreover, the idea was to close the container again after the first opening, with the centering and closure wall 14.

Figure 7:
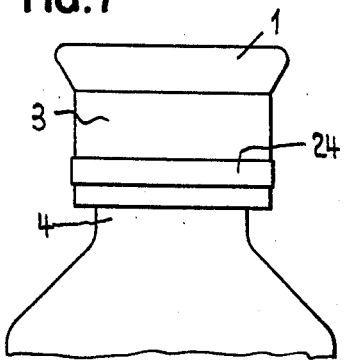
FIG. 7 is an elevational view of locking means for a closure member in accordance with the invention.

FIG. 7, by way of example, shows how the gripping portion 1 of the closure member is secured by a tear strip 24, which may be perforated, mounted on the flexible member 3, for receiving the edge region of the container 4.

Although in the embodiments described bottles are provided and shown as containers, the use of the closure member in accordance with the invention is, of course, not limited thereto. The closure member may, for example, just as well be used for closing tubes or tins, i.e., generally of containers which have to be opened and closed repeatedly. Within the invention concept various alternative embodiments are possible which permit the closure members to be adapted to a certain container. An essential feature is, however, that a laterally deformable material is used for its production and that the base is relatively rigid, i.e., reinforced. The gripping portion, moreover, may have print optionally provided on the outside thereof or a sticker.

I claim:

1. A closure member made of plastic material for a container, said closure member comprising a gripping portion and a hollow, substantially cylindrical sealing portion open at its upper end, said gripping portion having a depending container engaging wall member, said sealing portion being disposed adjacent said gripping portion and including a sealing wall and a centering member closing the lower end of said sealing portion, said centering member having a side wall offset from and parallel to said sealing wall, and a curved bottom wall extending outwardly and upwardly from a center point to said side wall, and wherein said wall member of said gripping portion, said centering member and said sealing wall are laterally deformable.

2. A closure member as recited in claim 1, additionally including a tear strip cooperating with said gripping portion.

3. The closure member as recited in claim 1 wherein the center point of said bottom wall of said centering member has a thickness greater than the thickness of the remaining walls of said sealing portion.

4. The closure member as recited in claim 1 wherein said gripping portion includes a frustro-conical annulus connected at its smaller diameter end to said sealing portion, said depending container engaging wall member being cylindrical and extending downwardly from an intermediate point on said annulus; and wherein a container engaging bead is formed on the lower, inner edge of said container engaging wall member.

5. A container in combination with a closure member made of plastic material, said closure member comprising a gripping portion and a hollow, substantially cylindrical sealing portion open at its upper end, said gripping portion having a depending container engaging wall member, said sealing portion being disposed adjacent said gripping portion and including a sealing wall and a centering member closing the lower end of said sealing portion, said centering member having a side wall offset from and parallel to said sealing wall, and a curved bottom wall extending outwardly and upwardly from a center point to said side wall, and wherein said wall member of said gripping portion, said centering member and said sealing wall are laterally deformable.

6. The combination as recited in claim 5, wherein said container has a neck portion having an opening therein, said depending wall member of said gripping portion being additionally provided with means for receiving the edge region of said container opening, said edge receiving means being located concentrically to said sealing portion.

7. The combination as recited in claim 6, wherein said means for receiving the edge region of said container opening comprises a flexible member, said flexible member forming a cavity with said sealing wall over the end face of said container.

8. The combination as recited in claim 7, wherein said container is provided with a bead portion at its end face, and wherein the inside surface of the means for receiving the edge region of said container opening is provided with a rib, said rib at least partly embracing said bead portion.

9. The combination as recited in claim 5, wherein said side wall of said centering member has a circumference which is slightly larger than the inside diameter of said container.

10. The combination as recited inclaim 5 additionally including a tear strip cooperating with said gripping portion.

* * * * *